United States Patent [19]

Schwarz et al.

[11] 4,269,114

[45] May 26, 1981

[54] FORCE-EXERTING MACHINE

[75] Inventors: Gail B. Schwarz, St. Louis; Lawrence F. Hickinbotham, High Ridge, both of Mo.

[73] Assignee: General Technology, Inc., St. Louis, Mo.

[21] Appl. No.: 873,656

[22] Filed: Jan. 30, 1978

[51] Int. Cl.[3] ..... B30B 15/16

[52] U.S. Cl. ..... 100/53; 100/229 A; 100/266; 100/269 A

[58] Field of Search ..... 100/53, 229 A, 269 A, 100/266

[56] References Cited

U.S. PATENT DOCUMENTS

| | | | |
|---|---|---|---|
| 186,577 | 1/1877 | Jones | 100/229 R |
| 3,654,855 | 4/1972 | Longo | 100/269 A |
| 3,717,089 | 2/1973 | Oles | 100/266 |
| 3,763,773 | 10/1973 | Clay | 100/269 A |
| 3,851,578 | 12/1974 | Engebretsen | 100/229 A |

*Primary Examiner*—Billy J. Wilhite

*Attorney, Agent, or Firm*—Sidney B. Ring; Hyman F. Glass

[57] ABSTRACT

This invention relates to a hydraulic force-exerting machine, such as a trash compactor, punch press, etc., which is characterized by the use of a flexible container in the hydraulic system as the force-exerting means.

16 Claims, 7 Drawing Figures

FORCE-EXERTING MACHINE

BACKGROUND OF THE INVENTION

This invention relates to a hydraulic force exerting machine such as trash compactor, punch press, etc.

In recent years trash compactors have assumed wide usage. However, most trash compactors currently employed compact trash by means of a mechanical force such as by means of a screw device.

SUMMARY OF THE INVENTION

We have now devised a simple, inexpensive hydraulic force-exerting machine which can be employed as a trash compactor which is characterized by the use of a flexible container in the hydraulic system as the force-exerting means.

In addition, we have devised a novel support for such container or other force receiving device comprising wheels supported on springs.

In the preferred embodiment the flexible container is made of any flexible material, for example rubber or flexible plastics, etc., which is reinforced to impart strength thereto so that at full expansion under the hydraulic pressure employed, it is restricted in size by its basic strength under the pressure employed.

BRIEF DESCRIPTION OF THE DRAWINGS

The invention is illustrated by the accompanying drawings in which.

DESCRIPTION OF THE PREFERRED EMBODIMENTS

Figure 1:
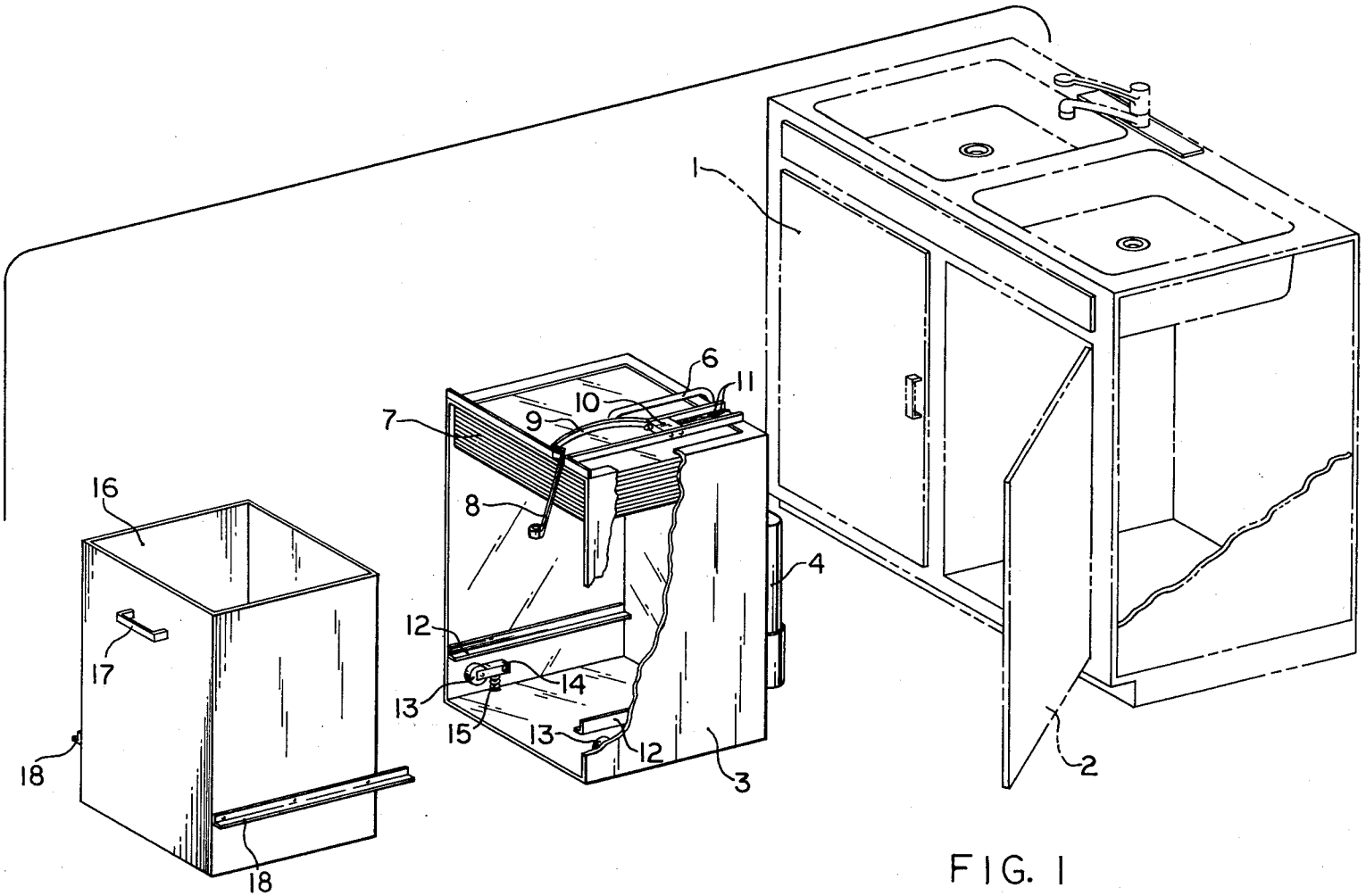
FIG. 1 is an exploded view of a sink cabinet, compactor housing and trash bucket.

The flexible container is made of any suitable flexible material, for example rubber or flexible plastics, etc. which is preferably reinforced to impart strength thereto so that at full expansion under the pressure employed, it is restricted in size by its basic strength. An example of a commercially available flexible container is a reinforced rubber product sold by Firestone which is employed as a shock absorber—"airride." The "airride" actually is an air suspension employed in lieu of springs to soften the ride.

The force of the machine is exerted on the object by means of a plunger. In order to protect the flexible materials such as rubber, plastics, etc, in the pressure activator, non-flexible materials such as metals are employed. The metals and flexible materials are combined into a united structure of flexible and non-flexible material, maximizing the most effective use of each material. Effective seals are used where the flexible material is joined to the non-flexible material so that a tight container is created which is capable of maintaining the desired hydraulic pressure. Thus, a flexible container relates to one containing flexible material alone or flexible material in combination with non-flexible materials which can maintain a hydraulic pressure and thus act as a pressure activator.

In principle, the greater the ratio of area of the base of the flexible container to the area of the pressure inlet tube, the greater the magnification of the force exerted.

The flexible container is an inexpensive way to obtain a large base area as compared to a corresponding sized metal container.

The compactor system is unique in that a small increase in the inlet hydraulic pressure imparts a great increase of downward pressure to the flexible container. In contrast to the inexpensive flexible container system of this invention it would be very expensive to use a metal container of comparable size to effect comparable compacting pressures.

This invention is a force-exerting device such as a trash compactor, press, etc. which is characterized by (1) a housing, containing (2) a plunger activated by (3) a flexible container capable of holding fluid under the pressures employed (4) a fluid inlet to the flexible container and (5) means for exerting a pressure on the fluid in the flexible container so as to activate the plunger capable of exerting sufficient force to exert the desired force such as to compact trash, press, etc.

Pressure may be created by the pressure of the water system itself if the water pressure is sufficiently high and reliable, or by other means such as a pump, etc. The hydraulic system requires no additional plumbing since it is self contained. Other fluids besides water can be used if desired.

The flexible container is the activating means for a plunger or compacting means. In practice it is advantageous to have a metal covering or plate for the flexible container so that it can impart pressure or compaction to the trash without damaging the flexible container. The downward course and return of the plunger is guided by any suitable guiding means.

Figure 5:
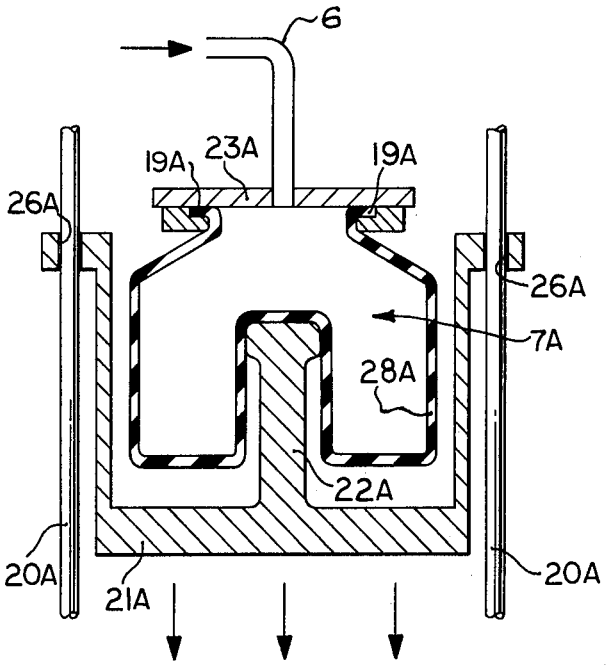
FIGS. 5, 6, and 7 show different types of plungers activated by flexible containers.
Figure 6:
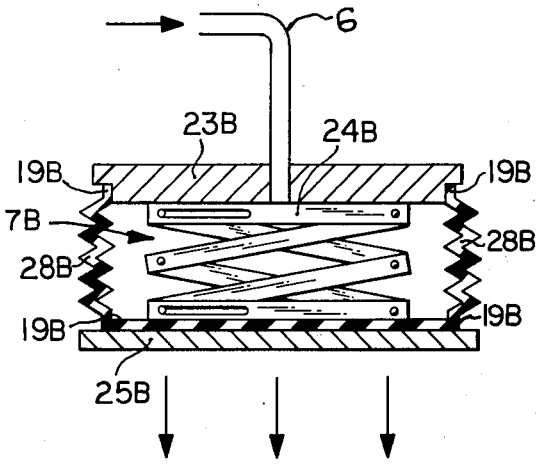
Figure 7:
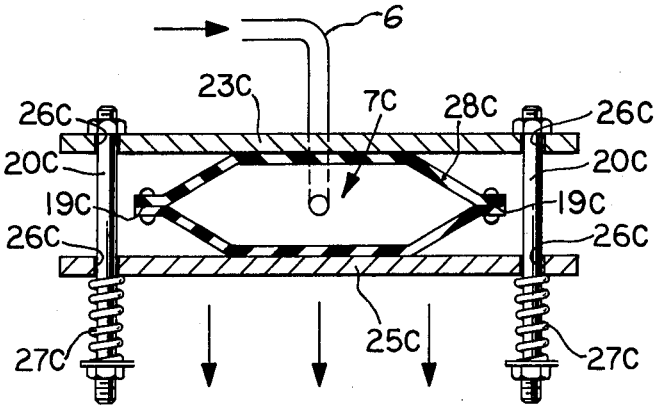

FIG. 1 is a perspective view of a trash compactor designed for a sink cabinet 1 which contains the compactor housing 3 and the trash bucket 16. The compactor housing 3 fits into the cabinet space behind the open door 2 and the trask bucket 16 fits into the compactor housing 3. The compactor housing 3 contains a fluid reservoir 4, a fluid pump 5, a fluid pipe 6 and a pressure activator 7 made of flexible materials. Fluid pipe 6 is connected to a fluid opening in the flexible container of the pressure activator as illustrated in FIGS. 5, 6 and 7. The lower inner wall of the main housing 3 contains overhead guide rails 12, support wheels 13, support wheel springs 15, support wheel brackets 14. The trash bucket 16 contains trash bucket rails 18 on the side which fits between the overhead guide rails 12 and the carrier support wheels 13. The trash bucket 16 is supported by the bucket support wheel springs 15 until pressure is exerted by the pressure activator 7 whereupon it rests on the bottom.

The trash bucket handle is indicated by the numeral 17.

Figure 2:
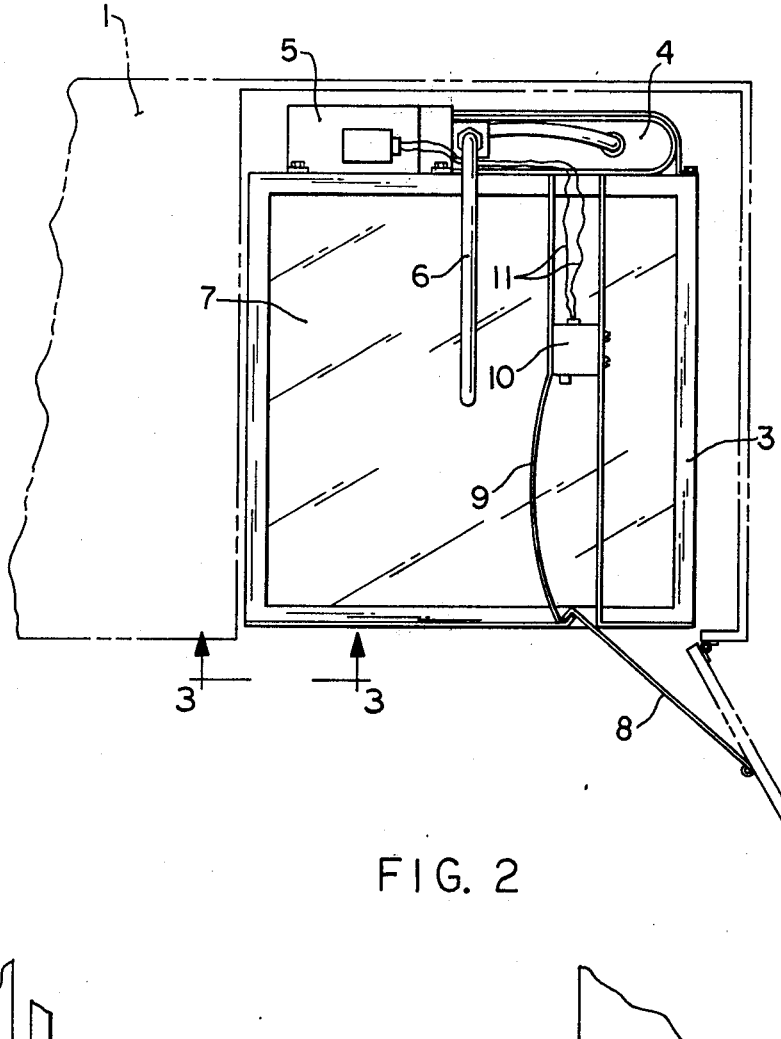
FIG. 2 is a top view of the compactor housing.

FIG. 2 is a top view of the main compactor housing 3 showing the cabinet door 2 and the safety interlock arm 8, the safety interlock activator 9, the safety interlock switch 10, the safety interlock switch wires 11 to pump 5, the fluid pump 5, the fluid reservoir 4, and the fluid pipes 6.

Figure 3:
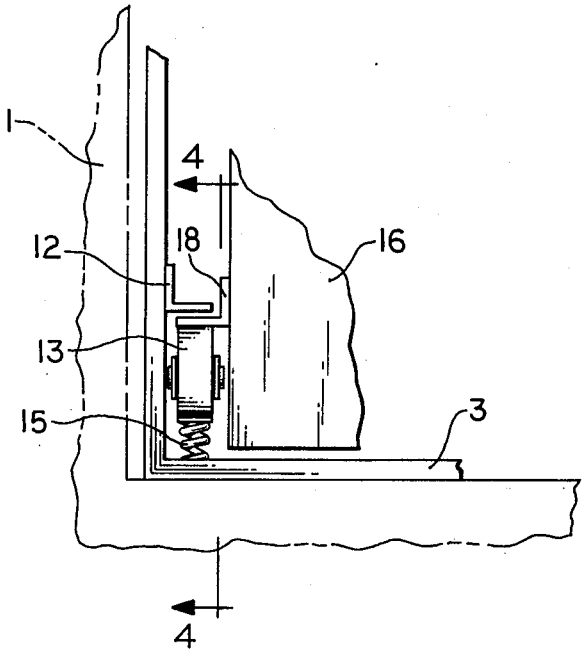
FIGS. 3 and 4 illustrate the wheel supports mounted on springs.

FIG. 3 is a front view along line 3—3 of FIG. 2 showing the interrelationship of parts in the lower corner thereof.

Figure 4:
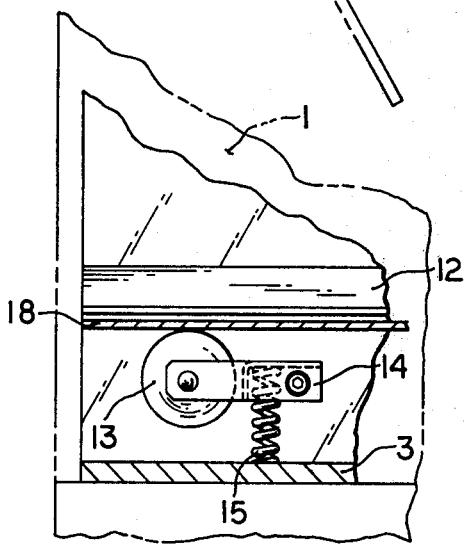

FIG. 4 is a cross-sectional side view along line 4—4 of FIG. 3 showing the interrelationship of parts in the lower corner thereof.

FIGS. 5, 6, and 7 are cross-sectional views illustrating different types of plungers activated by flexible containers.

The different pressure activators in these figures are indicated generally by the legends 7A, 7B and 7C, respectively.

FIG. 5 illustrates the use of flexible materials 28A of the pressure activator 7A sealed to the top plate 23A by a seal 19A. The pressure activator 7A is protected by a cylinder plate 21A containing a mid stem 22A indenting the middle of pressure activator's 7A flexible container material 28A. Two activator guide posts 20A are positioned into the guide posts openings 26A in the lips of the cylinder plate 21A thus guiding the force-exerting unit in its up and down motion.

FIG. 6 is an embodiment of a pressure activator 7B containing flexible materials 28B, in bellows form, a bottom plate 25B, a top plate 23B attached with seals 19B to the flexible material 28B. Inside the pressure activator 7B is scissors stabilizer 24B which keeps the top and bottom plates 23B and 25B parallel. The illustration in FIG. 1 employs a pressure activator 7B of the bellows type shown in FIG. 6 although other types can also be employed.

FIG. 6 illustrates an embodiment which is useful in a metal punch press since it has a shallow stroke in contrast to FIG. 5 which has a deep stroke and therefore more useful when used as a metal forming press.

FIG. 7C has a pressure activator 7 whose flexible materials 28C are sealed at 19C. The top pressure activator plate 23C and bottom pressure activator plate 25C are guided by guide posts 20C inserted through guide post insert holes 26C. The top and bottom plates are separated by the pressure activator. The bottom plate is supported by guide post springs 27C.

The three downward arrows on FIGS. 5, 6, and 7 indicate the direction of the exerted force. Where a press is the intended purpose of the force-exerting machine, a suitable tool such as a metal press die, a metal punch out die, a metal forming die, etc. is positioned on the bottom plate 25 so as to affect the desired effect on the work piece.

The bellows configuration in FIG. 1 and FIG. 6 filling the main housing 3 allows the plunger to operate without the guide posts 20 shown in FIG. 5 and FIG. 7.

The bucket rail 18, overhead guide rails 12 in the compactor housing 3, the support wheels 13, and the support wheel springs 15 avoids the need for a heavily reinforced base since the force is absorbed by this system. The interrelationship of bucket rails 18 to overhead guide rails 12 allows the trash bucket 16 to be withdrawn from the housing 3 without tipping.

The following illustrates the operation of the trash compactor.

As the trash compartment is inserted into the compactor housing it activates the safety interlock. This is a safety feature so that without the insertion the compactor will not operate. When the switch is turned on, the pump forces water under pressure through the tube into the flexible container, causing the plunger to exert a downward pressure on the trash with resulting compaction of the trash. When compaction is complete, the water pressure is released and the plunger returns to its original position.

The unit is small enough to fit under the sink basin inside the standard kitchen sink cabinet. The housing is closed around three sides to prevent a child or small animal from crawling inside the kitchen cabinet and being injured during the operation of the compactor. This small size is made possible by the fact that the flexible container has a stroke longer than its collapsed length. The housing is open to the front where it contacts the inside of the cabinet door. An activator on the cabinet door serves as an interlock in the control valve so that the unit cannot be operated when the door is open. An on-off lever can be set whenever the bucket becomes full; so that, the next time the door interlock comes inside the valve body, the compacting cycle is initiated. The conclusion of the cycle comes about when full pressure is reached, whereupon fluid is evacuated from the flexible container by syphon action.

The main advantages of this trash compactor are: Low cost of manufacture (no finished cabinet necessary, simple mechanism), convenient retrofit location and mounting beneath the existing kitchen sink, trouble free operation with little or no servicing.

This invention can also be used as a force-exerting machine for other uses such as for example a low cost, light weight metal stamping press, for a wide variety of uses such as plastic molding, in the press forming and clamping of powder metals, etc. where the pressure plunger activated by the flexible-container in the hydraulic system is adapted to a device which can effect metal stamping, plastic molding and forming and the clamping of press powder metals, etc.

We claim:

1. A force-exerting device characterized by
(1) a housing, containing
(2) a plunger activated by
(3) a flexible expandable container capable of holding fluid and of expanding in volume from an original position under fluid pressure employed, and capable of maintaining hydraulic pressure and of returning to its original position upon release of said pressure,
(4) a single fluid opening to the flexible container, and
(5) means for exerting pressure to the fluid when it is in the flexible container by way of the fluid opening sufficient to magnify the applied pressure thus causing the plunger to exert the desired force,
(6) said housing providing space for a bucket to be inserted and to be positionable therein for opposing the motion of the plunger, when the bucket contains compactable material therein, as the plunger exerts its force,
(7) wheels on springs in the housing positioned to contact the bucket when positioned therein to aid its positioning in the housing and to support the bucket when positioned therein, and
(8) said spring being so placed as to absorb in compression the force applied to the bucket and to the compactable material therein.

2. Claim 1, where the plunger comprises flexible material unitized with non-flexible material capable of protecting the flexible material when exerted pressure is applied.

3. Claim 2 where the non-flexible material is metal.

4. Claim 3 where the plunger has means for guiding the force exerted.

5. The device of claim 1 which is a trash compactor having a door on the housing permitting insertion of said bucket and which has an electrically powered pump for applying pressure to the fluid and which further has a door operated safety interlock mechanism including a switch and wires to the pump from the switch so that the trash compactor is inoperable when the door is open, the switch operating upon the wires to the pump.

6. The device of claim 1 wherein the housing includes guide rails to interact with matching guide rails on said bucket so as to prevent tipping of said bucket when positioned therein.

7. The device of claim 6 which is a trash compactor having a door on the housing permitting insertion of said bucket and which has an electrically powered pump for applying pressure to the fluid and which further has a door-operated safety interlock mechanism including a switch and wires to the pump from the switch so that the trash compactor is inoperable when the door is open, the switch operating upon the wires to the pump.

8. The device of claim 7 including said bucket positioned within the housing, said bucket having guide rails to interact with the guide rails in the housing, and said bucket being supported by the said wheels contacting the undersides of the guide rails of the bucket.

9. The device of claim 8 including a fluid reservoir, a pipe from the reservoir to the pump and a pipe from the pump to said single fluid opening to the flexible container, said reservoir, pipes, pump and fluid opening constituting fluid inlet means whereby fluid can be supplied under pressure to the flexible container and to exert pressure on the fluid therein and, upon release of pumping pressure, means whereby fluid is evacuated from the flexible container by syphon action.

10. The device of claim 9 wherein the flexible container comprises a chamber defined by (a) pleated bellows walls formed of flexible material capable of returning to an original position upon release of pressure on fluid in the chamber
(b) a non-flexible top plate having fluid inlet means hydraulically sealed thereto and
(c) a bottom section of flexible material, said bottom section being united to a non-flexible plate serving as said plunger, and said container incorporates
(d) a scissors stabilizer within said chamber to maintain said top and bottom plates parallel.

11. The device of claim 9 wherein (a) the plunger is the bottom plate of a non-flexible container open at the top and having a non-flexible mid stem directed into the interior of said non-flexible container,
(b) wherein the flexible container is an expandable container positioned within said non-flexible container and with its bottom portion indented by and united to said mid stem, said flexible container being hydraulically sealed at its top portion by a non-flexible top plate having fluid inlet means, and said flexible container is of sufficient size to be capable of transferring force to said plunger when expanded by applied fluid pressure upon fluid contained therein and is capable of retracting upon release of pressure,
(c) said non-flexible container having externally extending lips providing openings for guide posts, and
(d) guide posts positioned into said guide post openings for guiding the plunger in its up and down motion.

12. The device of claim 9 wherein elements (2) and (3) of the device comprise (a) a non-flexible top plate and, parallel thereto, a non-flexible bottom plate constituting said plungers, said plates having holes near their peripheries for inserting guide posts passing through the holes for maintaining parallelism of the plates,
(b) guide posts passing through the holes, each guide post passing through both plates,
(c) a flexible container in the space between the plates and unitized at its top and bottom to each of said plates, said flexible container being capable of transferring force to said plunger when expanded by applied fluid pressure upon fluid contained therein and being capable of retracting upon release of pressure,
(d) confined guide post springs encircling said guide posts and bearing upon said bottom plate for exerting force to maintain parallelism of the plates, and
(e) fluid inlet means passing through the top plate and the portion of the flexible container adhering thereto for supplying fluid to the flexible container.

13. A force-exerting device characterized by (1) a housing, containing
(2) a plunger activated by
(3) a flexible container capable of holding fluid and of expanding in volume from an original position under fluid pressure employed and capable of returning to its original position upon release of said pressure
(4) a single fluid opening to the flexible container,
(5) a fluid reservoir
(6) a pump
(7) pipes from the fluid reservoir to the pump and from the pump to the fluid opening to the flexible container, said reservoir, pump, pipes and fluid opening constituting fluid inlet means whereby fluid can be supplied under pressure to the flexible container and, upon release of pressure, means whereby fluid is evacuated from the flexible container by syphon action.

14. The device of claim 13 wherein the flexible container comprises a chamber defined by (a) pleated bellows walls formed of flexible material capable of returning to an original position upon release of pressure on fluid in the chamber
(b) a non-flexible top plate having fluid inlet means hydraulically sealed thereto and
(c) a bottom section of flexible material, said bottom section being united to a non-flexible plate serving as said plunger, and said container incorporates
(d) a scissors stabilizer within said chamber to maintain said top and bottom plates parallel.

15. The device of claim 13 wherein (a) the plunger is the bottom plate of a non-flexible container open at the top and having a non-flexible mid stem directed into the interior of said non-flexible container,
(b) wherein the flexible container is an expandable container positioned within said non-flexible container and with its bottom portion indented by and united to said mid stem, said flexible container being hydraulically sealed at its top portion by a non-flexible top plate having fluid inlet means, and said flexible container is of sufficient size to be capable of transferring force to said plunger when expanded by applied fluid pressure upon fluid contained therein and is capable of retracting upon release of pressure,
(c) said non-flexible container having externally extending lips providing openings for guide posts, and (d) guide posts positioned into said guide posts openings for guiding the plunger in its up and down motion.

16. The device of claim 13 wherein elements (2) and (3) of the device comprise (a) a non-flexible top plate and, parallel thereto, a non-flexible bottom plate constituting said plunger, said plates having holes near their peripheries for inserting guide posts passing through the holes for maintaining parallelism of the plates, (b) guide posts passing through the holes, each guide post passing through both plates, (c) a flexible container in the space between the plates and unitized at its top and bottom to each of said plates, said flexible container being capable of transferring force to said plunger when expanded by applied fluid pressure upon fluid contained therein and being capable of retracting upon release of pressure, (d) confined guide post springs encircling said guide posts and bearing upon said bottom plate for exerting force to maintain parallelism of the plates, and (e) fluid inlet means passing through the top plate and the portion of the flexible container adhering thereto for supplying fluid to the flexible container.

* * * * *